US007234202B2

(12) United States Patent
Li

(10) Patent No.: US 7,234,202 B2
(45) Date of Patent: Jun. 26, 2007

(54) SEMIAUTOMATIC FINGER PROTECTION DEVICE FOR DOORS

(76) Inventor: Kai Yip Li, Flat F, 16/F., Block 12, Laguna City, Kowloon (HK)

( * ) Notice: Subject to any disclaimer, the term of this patent is extended or adjusted under 35 U.S.C. 154(b) by 121 days.

(21) Appl. No.: 10/944,867

(22) Filed: Sep. 21, 2004

(65) Prior Publication Data

US 2006/0026793 A1 Feb. 9, 2006

(30) Foreign Application Priority Data

Jul. 20, 2004 (CN) ..... 2004 1 0005287

(51) Int. Cl.
*E05F 5/02* (2006.01)

(52) U.S. Cl. ..... 16/82; 16/85; 16/86 R

(58) Field of Classification Search ..... 16/82, 16/78, 85, 86 R, 86 A, 86 B; 160/40; 49/383, 49/384
See application file for complete search history.

(56) References Cited

U.S. PATENT DOCUMENTS 2,280,541 A * 4/1942 Persson ..... 160/40
2,681,480 A * 6/1954 Dixon, Sr. ..... 49/383
5,369,840 A * 12/1994 Salvador et al. ..... 16/82
6,003,911 A * 12/1999 Sowash ..... 292/343

FOREIGN PATENT DOCUMENTS

DE 3626924 A1 * 2/1988
DE 3716654 A1 * 12/1988
GB 2218449 A 11/1989
GB 2306538 A 5/1997
WO WO 9305263 A1 * 3/1993

OTHER PUBLICATIONS

Doraiswamy et al., Isolated Finger Injuries In Children—Incidence And Aetiology, INJURY, Oct. 2000, vol. 31, Issue 8, pp. 571-573 (abstract).

* cited by examiner

*Primary Examiner*—Robert J. Sandy
*Assistant Examiner*—Michael J. Kyle
(74) *Attorney, Agent, or Firm*—Rabin & Berdo, P.C.

(57) ABSTRACT

The present discloses a semiautomatic finger protection device, which comprising a bumper positioned between an outer surface of the door and an doorpost when the door is closed, and positioned in a gap on the hinge side of the door when the door is opened; a securing member to position the bumper; and a connecting member having the two ends retractably connected with said bumper and said securing member respectively. The bumper has a flexible wrapping means received in the bumper to extend/retract the connecting member.

21 Claims, 4 Drawing Sheets

SEMIAUTOMATIC FINGER PROTECTION DEVICE FOR DOORS

BACKGROUND OF THE INVENTION

1. Field of the Invention

The present invention relates to a safety device for doors, and more particularly to a protection device to prevent fingers or hands from being injured by doors.

2. Description of Related Art

It is very common that people carelessly have their hands or fingers injured by doors, especially for kids who are playing or not looked after.

An article, written by N. V. Doraiswamy etc., titled "Isolated finger injuries in Children-incidence and aetiology", published in an international journal <<Injury>> (Injury, Int. J. Care Injured, Volume 31, Issue 8, October 2000, Pages 571~573) disclosed that:

In a study, details were recorded prospectively in a specifically designed questionnaire for all children presenting to the Accident and Emergency Department with isolated finger injuries over a period of 6 months. Among the 426 injuries in 283 children, most occurred at home (59%) more in the <5 year age group (38%) . . . "Jamming/crushing" was the commonest reason (48%), mostly caused by a child (59%) at the living room door (32%) and more commonly at the hinge side (49%) . . . It is less common for a child to cause self-injury while closing the door . . . But the present study indicates that a child closing the door is common—(60%), although adults are also responsible for (25%) some of the incidents . . . Both children and adults should be educated about causation, reiterating that damage to fingers can be prevented or reduced by observing safety measures.

A door stopper can be used for preventing the door from being closed. However, when the door stopper is not installed in a correct position to block the door, an accident will easily occur.

A finger guard for doors has been invented. The finger guard has a bumper mounted on a lock side or a hinge side of a door to prevent the door from closing. For closing the door, a user should remove the bumper from the door. In other words, the bumper must be mounted on the door for taking effect when the user wants to prevent the door from closing. Therefore, once the bumper is not in position due to the user's neglect or carelessness, the probability of finger injuries still exists.

A finger protection device for doors is disclosed in a DE Patent No. DE3626924, granted to Domer Jorg Dr. -Ing etc., and includes elongated strip-like or bar-like covering bodies which are fixed on door-gap openings at the hinge side of the doors by thin and flexible connecting means to cover the door-gap openings. Although this device prevented fingers from being nipped by the door-gaps at the hinge side of the doors, the fingers may still be nipped by the door-gap openings on the lock side of the doors. Moreover, because this device extends from the top of the door to the bottom of the door, it is inconvenient to install this device.

A door finger guard is disclosed in U.K. Patent No. GB2218449, granted to Steven Swaddle etc. The door finger guard includes a bridge-linking strip member being composed of two end portions and two middle portions. The two middle portions attach to each other by a hinge portion, and the two end portions are secured on a door and a frame respectively to cover door-gap openings on the hinge side of the door. Because the components of the device are integrally made of plastic, the device has a short using life, and is easy to be deformed or broken. Moreover, this invention still has the disadvantage of allowing the door-gap openings on the lock side of the door to nip the fingers.

U.K. Patent No. GB2306538 to Stephen Robert Webb also discloses a door finger guard. This device has a structure similar to the invention as described above, and its primary object is to cover the door-gap openings on the hinge side of the door, so the same problems appear in the device.

Therefore, the invention provides a finger protection device for doors to mitigate or obviate the aforementioned problems.

SUMMARY OF THE INVENTION

The main objective of the present invention is to provide a semiautomatic finger protection device which can be securely provided on a door without reinstallation after the door is opened/closed to prevent hands or fingers from being nipped and injured by door-gap openings on the lock side of doors or on the hinge side of doors.

To achieve the objective of the invention, a semiautomatic finger protection device for doors comprising a bumper positioned between an outer surface of the door and an doorpost when the door is closed, and positioned in a gap on the hinge side of the door when the door is opened; a securing member to position said bumper; and a connecting member having the two ends retractably connected with said bumper and said securing member respectively.

In an embodiment, the bumper comprises a flexible wrapping means received in said bumper to extend/retract the connecting member.

In another embodiment, the securing member comprises a flexible wrapping means received in the securing member to extend/retract the connecting member.

The flexible wrapping means has an outer tube, and a first elongated slot longitudinally defined through the outer tube; the connecting member passes through the first elongated slot; an inner tube is received in the outer tube and fixed with one end of the connecting member, a spiral spring which is received in the inner tube, a first lid and a second lid, which are mounted on the two open ends of the outer tube respectively; and the spring has a first end connected with the first lid, and a second end secured on the inner tube.

A recess is defined in an interior walls of the first lid or the second lid, and an end of the inner tube is movably received in the recesses.

Alternatively, a first recess and a second recess are respectively defined in interior walls of the first lid and second lid, and two ends of the inner tube are respectively and movably received in the recesses.

The first lid has a lug formed at an interior wall facing the spiral spring, and the spiral spring is fastened on the lug.

Two bearings are respectively provided between the inner tube and the recesses.

The flexible wrapping means further has a shaft extending in the spiral spring and having a first end positioned in a first aperture defined in the lug of the first lid, and a second end positioned in a second aperture defined in the second recess of the second lid.

The connecting member is made of a pliant material with a small thickness for received in the door gap when the door is closed.

In a further embodiment, the connecting member is made of a flexible material with a small thickness for received in the door gap when the door is closed.

The bumper has a handling member mounted thereon, and the handling member can be a cord with two ends respectively fixed at the two lids.

The outer tube is made of a metal material, and has a first sheath provided outside the outer tube (210) and made of a flexible material. A second elongated slot is defined through the sheath and aligned with the first elongated slot for the connecting member passing therethrough.

The securing member has a cylindrical part, a third elongated slot longitudinally defined through the cylindrical part for the connecting member passing therethrough, and an axle, on which a second end of the connecting member is fixed, provided in the cylindrical part. The third elongated slot extends towards a first end of the cylindrical part to define as a semi-closed slot.

The securing member further comprises a first plug inserted in the first end of the cylindrical part to prevent the connecting member from escaping from the cylindrical part via the semi-closed slot. The securing member has an anti-slipping sheath provided outside the cylindrical part.

In another further embodiment, the securing member is a securing leaf.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
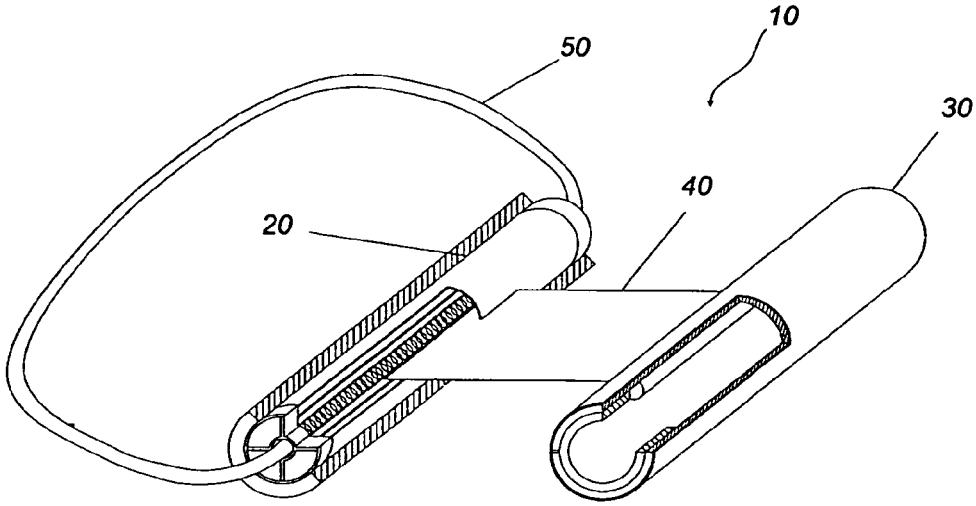
FIG. 1 is a perspective sectional view of an embodiment of a semi-automatic finger protection device according to the present invention.

Referring to FIG. 1, a semiautomatic finger protection device for doors (10) in accordance with the present invention is composed of a bumper (20), a securing member (30) and a connecting member (40) by which the bumper (20) and the securing member (30) are connected with each other.

Figure 2:
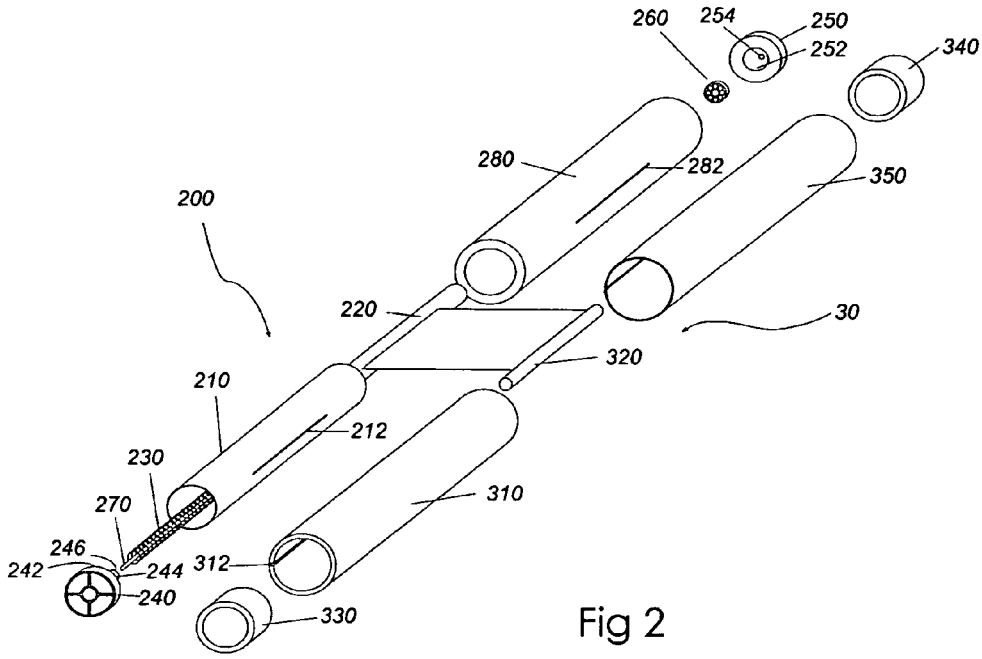
FIG. 2 is an exploded perspective view of FIG. 1.

In a first embodiment, as illustrated in FIG. 2, the bumper (20) includes a flexible wrapping means (200), which has an outer tube (210), an inner tube (220) rotatably received in the outer tube (210), a spiral spring (230) positioned in the inner tube (220), and a first lid (240) and a second lid (250).

A first elongated slot (212) is longitudinally defined through the outer tube (210) for the connecting member (40) passing therethrough. The first lid (240) and second lid (250) are respectively mounted at two open ends of the outer tube (210). The spiral spring (230) has a first end attached to the first lid (240). In this embodiment, the first lid (240) has a lug (244) formed at an interior wall facing the spiral spring (230), preferably at the center of the interior wall. The first end of the spiral spring (230) is fastened on the lug (244) and a second end of the spiral spring (230) is fastened on the inner tube (220). A first recess (242) and a second recess (252) are respectively defined in the interior walls of the first lid (240) and second lid (250), and two ends of the inner tube (220) are respectively and movably received in the recesses (242, 252). Two bearings (only one bearing (260) shown in FIG. 2 at the second recess (250)) are respectively provided between the inner tube (220) and the recesses (240, 250) for a smooth rotation of the inner tube (220) in the recess (240, 250).

For preventing the spiral spring (230) from twisting, a shaft (270) extends in the spiral spring (230) and has a first end positioned in a first aperture (246) defined in the lug (244) of the first lid (240). In this embodiment, a second end of the shaft (270) is positioned in a second aperture (254) defined in the second lid (250).

The outer tube (210) is preferably formed with a cylindrical shape (but not limited in this shape), so a pressure on the bumper (20) from the door and the hinge and frictions among the bumper (20) and the door and hinge both are small. The outer tube (210) is preferably made of a metal material having a sufficient hardness, such as stainless steel. If directly struck by the outer tube (210) of the bumper (20), the door will be damaged under collision and friction between the outer tube (210) and the door, so a sheath (280) is provided outside the outer tube (210). The sheath (280) can be made of an anti-slipping flexible material such as rubber. A second elongated slot (282) is defined through the sheath (280) and aligned with the first elongated slot (212).

The connecting member (40) is made of pliant material and is so thin that it can pass through a gap between the door and a frame when the door is in a closed status. The connecting member (40) is reeled on the inner tube (220) with a first end fixed on the inner tube (220) and a second end extending out from the elongated slots (212, 282) and fixed on an axle (320) in the securing member (30).

The securing member (30) has a cylindrical part (310). A third elongated slot (312) is longitudinally defined through the cylindrical part (310) and extending towards a first end of the cylindrical part (310) to define as a semi-closed slot. The second end of the connecting member (40) extends therethrough the third elongated slot (312). A first plug (330) is inserted in the first end of the cylindrical part (310) to prevent the connecting member (40) from escaping from the open end of the third elongated slot (312). A second plug (340) is inserted in a second end of the cylindrical part (310) to conceal the axle (320) in the cylindrical part (310). The cylindrical part (310) and axle (320) can be made of a rigid material. An anti-slipping member is provided outside the cylindrical part (310) to prevent the securing member (30) from sliding downwards due to the gravity. The anti-slipping member can be a second sheath (350) made of net-like soft plastic with a large friction so as to stably position the securing member (30).

Figure 3A:
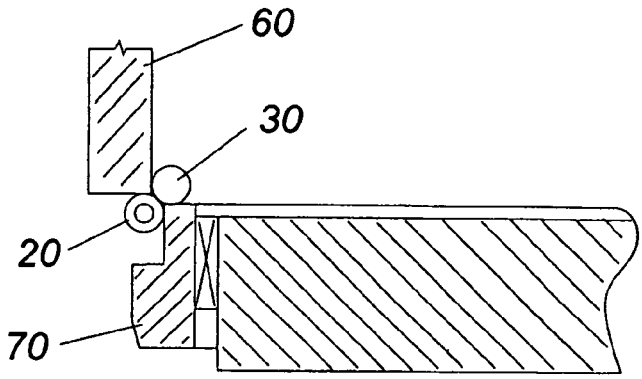
FIG. 3A–3C are schematically practice views of the semi-automatic finger protection device.
Figure 3B:
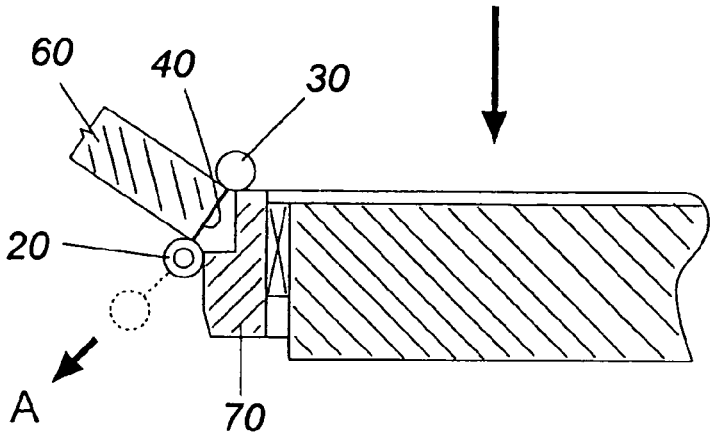
Figure 3C:
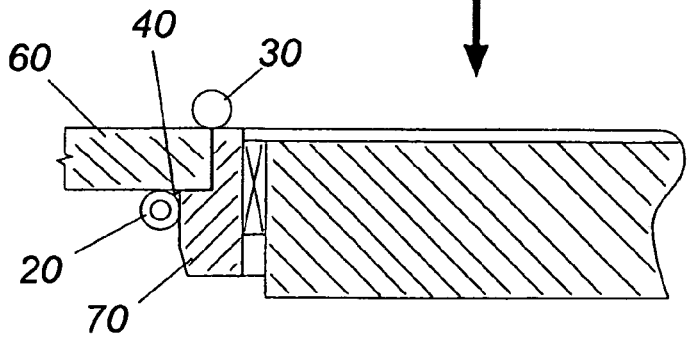

The embodiment of the invention in use is illustrated in FIGS. 3A–3C. With reference to FIG. 3A, the embodiment of the invention is in an original immovable status that the bumper (20) is located in a gap on the hinge side of the door, the securing member (30) is located between an inner side of the door (60) and a doorpost (70), and the connecting member (40) is received in the outer tube of the bumper (20) by the flexible wrapping means (200). The bumper (20) is positioned in the gaps on the hinge side of the door adjacent to the securing member (30) by the reeled connecting member (40). Because the first and second sheathes are provided outside the bumper and the securing member, the bumper and securing member will not slide in the gap on the hinge side of the door.

With reference to FIG. 3B, when the bumper (20) is pulled, the connecting member (40) extends out from the bumper (20) and is taken away from the gap on the hinge side of the door.

With reference to FIG. 3C, the door can be closed when the bumper (20) is taken away. The bumper (20) can be positioned between an outer side of the door (60) and the doorpost (70) under the elastic force. A handling member (50) such as a cord or a ring is provided on the bumper (20). In this embodiment, the handling member (50) is a cord with two ends respectively fixed at two lids (240, 250). Of course, other handling members are also allowable.

When the door is open again, the connecting member (40) is reeled back to the inner tube (220) under the force of the spiral spring. Thus, the bumper returns to the original position, e.g. the gap on the hinge side of the door, to block the door.

Of course, the bumper (20) and the securing member (30) can be formed with other proper shapes.

In another embodiment (not shown), the structure and elements of the bumper and securing member can be exchanged. The flexible wrapping means (200) can be installed in the securing member (30), and the bumper (20) is equal to the securing member in the first embodiment as described above.

Figure 4:
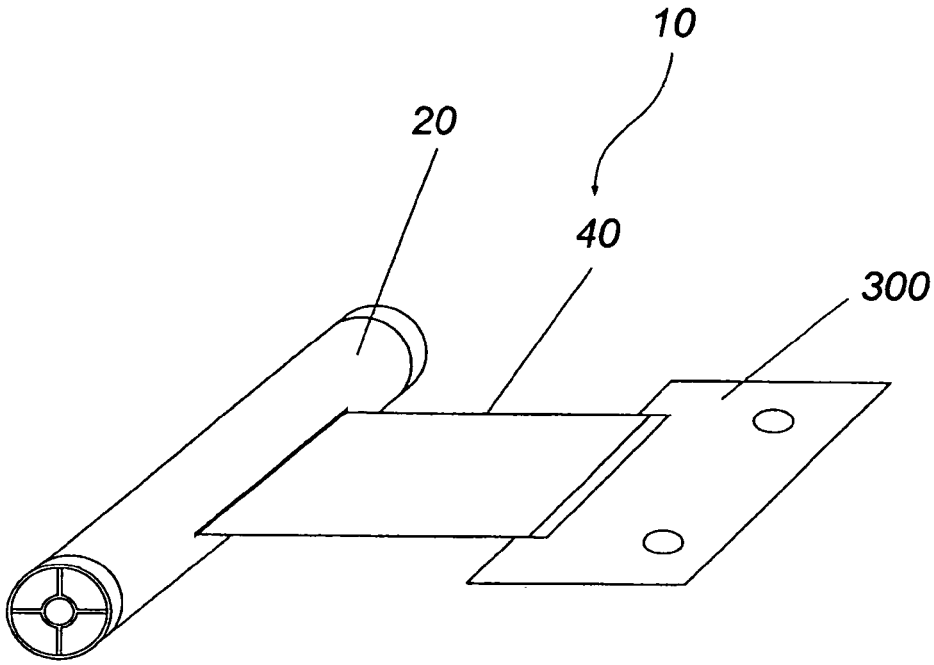
FIG. 4 is a perspective view of another embodiment in accordance with the present invention.

In a further embodiment, as shown in FIG. 4, all the components are the same as that of the first embodiment except that the securing member is constructed by a securing leaf (300). The securing leaf (300) is secured on the inner surface of the door or the doorpost by screws or adhesive. The second end of the connecting member (40) is fixed on the securing leaf (300). Of course, the securing member can also be secured on the inner surface of the door or the doorpost by other means.

In a fourth embodiment of the present invention (not shown), the bumper and the securing member are securely connected with the connecting member. The connecting member is made of an elastic material with a very small thickness. The bumper can be a thing with any proper shape that is able to be clamped in the door-gap on the hinge side of the door to prevent the door from being closed, while the securing member can be a thing with any shape that is able to be secured on the inner surface of the door or the doorpost by using various conventional methods. In using, the object of the present invention can be achieved by the retractable connecting member.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A semiautomatic finger protection device for a door, comprising:

a bumper positioned between an outer surface of a door and a doorpost when the door is closed, and positioned in a gap on a hinge side of the door when the door is opened;

a securing member to position said bumper;

a connecting member having the two ends retractably connected with said bumper and said securing member, respectively; and a flexible wrapping means disposed inside said bumper or said securing member for extending and contracting said connecting member, wherein said flexible wrapping means has an outer tube, and a first elongated slot longitudinally defined through said outer tube; said connecting member passes through said first elongated slot; an inner tube is received in said outer tube and fixed with one end of said connecting member, a spiral spring which is received in said inner tube, a first lid and a second lid, which are mounted on two open ends of said outer tube, respectively; and said spring has a first end connected with said first lid, and a second end secured on said inner tube.

2. A semiautomatic finger protection device for a door, comprising:

a bumper positioned between an outer surface of a door and a doorpost when the door is closed, and positioned in a gap on a hinge side of the door when the door is opened to block the door from being closed;

a securing member to position said bumper;

a connecting member having the two ends retractably connected with said bumper and said securing member, respectively; and a handling member attached to said bumper, and being adapted to allow a user to pull the bumper from the gap, to thereby allow the door to be closed;

wherein said securing member comprises a flexible wrapping means received in said securing member to extend/retract said connecting member; and wherein said flexible wrapping means has an outer tube, and a first elongated slot longitudinally defined through said outer tube; said connecting member passes through said first elongated slot; an inner tube is received in said outer tube and fixed with one end of said connecting member, a spiral spring which is received in said inner tube, a first lid and a second lid, which are mounted on the two open ends of said outer tube respectively; and said spring has a first end connected with said first lid, and a second end secured on said inner tube.

3. The semiautomatic finger protection device as claimed in claim 1, wherein a recess is defined in an interior walls of said first lid (240) or said second lid (250), and an end of said inner tube (220) is movably received in said recesses.

4. The semiautomatic finger protection device as claimed in claim 1, wherein a first recess (242) and a second recess (252) are respectively defined in interior walls of said first lid (240) and second lid (250) and two ends of the inner tube (220) are respectively and movably received in said recesses (242, 252).

5. The semiautomatic finger protection device as claimed in claim 1, wherein said first lid (240) has a lug (244) formed at an interior wall facing said spiral spring (230), and said spiral spring (230) is fastened on said lug (244).

6. The semiautomatic finger protection device as claimed in claim 3, wherein two bearings are respectively provided between said inner tube (220) and said recesses (240, 250) of said first and second lids.

7. The semiautomatic finger protection device as claimed in claim 4, wherein said flexible wrapping means (200) further has a shaft (270) extending in the spiral spring (230) and having a first end positioned in a first aperture (246) defined in a lug (244) of the first lid (240), and a second end positioned in a second aperture (254) defined in said second recess (252) of said second lid (250).

8. The semiautomatic finger protection device as claimed in claim 2, wherein the connecting member is made of a flexible material with a small thickness for being received in the door gap when the door is closed.

9. The semiautomatic finger protection device as claimed in claim 2, wherein the connecting member is made of pliant material with a small thickness for being received in the door gap when the door is closed.

10. The semiautomatic finger protection device as claimed in claim 1, wherein said bumper (20) has a handling member (50) mounted thereon.

11. A semiautomatic finger protection device for a door, comprising:

a bumper positioned between an outer surface of a door and a doorpost when the door is closed, and positioned in a gap on a hinge side of the door when the door is opened;

a securing member to position said bumper;

a connecting member having the two ends retractably connected with said bumper and said securing member, respectively, the connecting member being made of pliant material with a small thickness for being received in the gap when the door is closed;

a flexible wrapping means disposed inside said bumper or said securing member for extending and contracting said connecting member, and a handling member external of said bumper or said securing member, comprising a cord with two ends respectively fixed at two lids at the ends of the flexible wrapping means for user manipulation.

12. The semiautomatic finger protection device as claimed in claim 1, wherein said outer tube (210) has a first sheath (280) provided outside said outer tube (210) and made of an anti-slipping flexible material, a second elongated slot (282) is defined through said sheath (280) and aligned with said first elongated slot (212) for said connecting member (40) passing therethrough.

13. The semiautomatic finger protection device as claimed in claim 1, wherein said securing member (30) has a cylindrical part (310), a third elongated slot (312) longitudinally defined through the cylindrical part (310) for said connecting member (40) passing therethrough, and an axle (320), on which a second end of said connecting member (40) is fixed, provided in said cylindrical part (30).

14. The semiautomatic finger protection device as claimed in claim 13, wherein said elongated slot (312) extends towards a first end of the cylindrical part (310) to define as a semi-closed slot (312).

15. The semiautomatic finger protection device as claimed in claim 12, wherein said securing member (30) further comprises a first plug (330) inserted in said first end of the cylindrical part (310) to prevent said connecting member (40) from escaping from said cylindrical part (310) via said semi-closed slot (312).

16. The semiautomatic finger protection device as claimed in claim 12, wherein said securing member (30) has an anti-slipping sheath (350) provided outside said cylindrical part (310).

17. The semiautomatic finger protection device as claimed in claim 1, wherein said bumper has a cylindrical part, a third elongated slot longitudinally defined through the cylindrical part for said connecting member passing therethrough, and an axle, on which a second end of said connecting member is fixed, provided in said cylindrical part.

18. The semiautomatic finger protection device as claimed in claim 15, wherein said elongated slot extends towards a first end of the cylindrical part to define as a semi-closed slot.

19. The semiautomatic finger protection device as claimed in claim 16, wherein said bumper (20) further comprises a first plug inserted in said first end of the cylindrical part to prevent said connecting member from escaping from said cylindrical part via said semi-closed slot.

20. The semiautomatic finger protection device as claimed in claim 16, wherein said bumper (20) has an anti-slipping sheath (350) provided outside said cylindrical part.

21. The semiautomatic finger protection device as claimed in claim 1, wherein said outer tube (210) is made of a metal material.

* * * * *